US009500028B2

(12) United States Patent
Cale

(10) Patent No.: US 9,500,028 B2
(45) Date of Patent: Nov. 22, 2016

(54) CUSTOM MOLD PRESS LADDER

(71) Applicants: Compagnie Generale des Etablissements Michelin, Clermont-Ferrand (FR); Michelin Recherche et Technique S.A., Granges-Paccot (CH)

(72) Inventor: Andrew Stephan Cale, Greenville, SC (US)

(73) Assignees: Compagnie Generale des Etablissements Michelin, Clermont-Ferrand (FR); Michelin Recherche et Technique S.A., Granges-Paccot (CH)

( * ) Notice: Subject to any disclaimer, the term of this patent is extended or adjusted under 35 U.S.C. 154(b) by 0 days.

(21) Appl. No.: 14/892,467

(22) PCT Filed: Aug. 8, 2014

(86) PCT No.: PCT/US2014/050320

§ 371 (c)(1),
(2) Date: Nov. 19, 2015

(87) PCT Pub. No.: WO2015/023527

PCT Pub. Date: Feb. 19, 2015

(65) Prior Publication Data

US 2016/0108671 A1 Apr. 21, 2016

Related U.S. Application Data

(60) Provisional application No. 61/864,676, filed on Aug. 12, 2013.

(51) Int. Cl.

| | |
|---|---|
| ***E06C 1/00*** | (2006.01) |
| ***E06C 1/39*** | (2006.01) |
| ***E06C 1/397*** | (2006.01) |

(Continued)

(52) U.S. Cl.

CPC ..... *E06C 1/39* (2013.01); *E06C 1/397* (2013.01); *E06C 7/182* (2013.01); *E06C 9/12* (2013.01)

(58) Field of Classification Search

CPC ..... E06C 9/12; E06C 1/39; E06C 1/393; E06C 7/16; E06C 7/181; E06C 7/182; E06C 7/188; E06C 7/488; E06C 7/50; E06C 9/00; E04H 4/144

See application file for complete search history.

(56) References Cited

U.S. PATENT DOCUMENTS

| | | | | | |
|---|---|---|---|---|---|
| 836,785 | A * | 11/1906 | Shumaker | E06C 1/345 | 182/103 |
| 1,829,346 | A * | 10/1931 | Frommeyer | E06C 1/393 | 182/125 |
| 2,035,537 | A * | 3/1936 | Cowan | E06C 5/04 | 182/113 |

(Continued)

FOREIGN PATENT DOCUMENTS

WO WO 2010046670 A1 4/2010

OTHER PUBLICATIONS

International Search Report with written opinion dated Nov. 14, 2014.

*Primary Examiner* — Daniel Cahn
(74) *Attorney, Agent, or Firm* — Neal P. Pierotti

(57) ABSTRACT

A ladder that employs an existing custom mold press frame to support itself thereon is provided along with a method of installation. A clamping engagement system employed by such a ladder is also provided along with a kit for installing the ladder with a mold press frame.

12 Claims, 8 Drawing Sheets

(51) Int. Cl.
*E06C 7/18* (2006.01)
*E06C 9/12* (2006.01)

(56) References Cited

U.S. PATENT DOCUMENTS 2,172,860 A * 9/1939 Weaver ..... E06C 1/393 182/106
2,187,633 A * 1/1940 Smith ..... B63B 27/14 114/362
2,388,892 A * 11/1945 Wilson ..... E06C 1/20 182/106
2,678,243 A 5/1954 Masse
2,798,652 A * 7/1957 Easton ..... E06C 1/24 16/33
2,881,028 A * 4/1959 Baird ..... E06C 7/16 182/113
2,957,541 A * 10/1960 Everest ..... E06C 1/34 182/115
3,012,626 A * 12/1961 Marryatt ..... E06C 7/081 182/113
3,059,721 A * 10/1962 Straw ..... E06C 1/34 182/13
3,090,465 A * 5/1963 Smith ..... E04H 4/1209 182/52
3,090,489 A * 5/1963 Smith ..... E04H 4/1209 182/52
3,142,355 A * 7/1964 Danielson ..... A47B 45/00 182/106
3,586,124 A * 6/1971 Kunzweiler ..... E04H 4/144 182/106
3,664,458 A * 5/1972 Sterns ..... E06C 1/397 182/102
3,908,795 A * 9/1975 Gannon ..... E04H 4/144 182/118
3,991,851 A * 11/1976 Gannon ..... E04H 4/144 182/106
4,418,792 A * 12/1983 Cerone ..... A61G 7/1005 182/106
4,552,247 A * 11/1985 Purdy ..... A01M 31/02 182/116
4,648,481 A * 3/1987 Lee ..... A47C 12/02 182/106
5,022,491 A * 6/1991 Gill ..... E06C 9/14 182/163
5,044,465 A * 9/1991 Rinke ..... E06C 9/08 182/106
5,148,889 A * 9/1992 Fenwick ..... E06C 9/12 182/115
5,333,323 A * 8/1994 Aymes ..... E04H 4/144 182/93
5,480,002 A * 1/1996 Kerr ..... E06C 9/12 182/115
5,845,741 A * 12/1998 Dwyer ..... E06C 9/14 182/84
6,533,069 B1 * 3/2003 Couillard ..... E06C 1/34 182/107
6,598,562 B1 * 7/2003 Dutkiewicz ..... A01K 1/035 119/706
6,907,957 B1 * 6/2005 Couch ..... E02D 17/08 182/106
7,637,350 B2 * 12/2009 Conroy ..... B63B 27/14 182/204
D669,194 S * 10/2012 Meyer ..... D25/64
8,746,403 B1 * 6/2014 Tyner ..... E06C 1/30 182/106
8,869,935 B2 10/2014 Baglin
9,091,120 B2 * 7/2015 Gabriel
9,194,180 B2 * 11/2015 Hedley ..... E06C 5/02
2003/0132059 A1 * 7/2003 Saputo ..... E04H 4/144 182/118
2005/0056489 A1 * 3/2005 Walsh ..... E06C 1/393 182/156
2005/0082117 A1 * 4/2005 Morral Gispert ..... E04H 4/144 182/93
2006/0169535 A1 * 8/2006 Phillips ..... E06C 1/39 182/119
2008/0092285 A1 * 4/2008 Petersen ..... E04H 4/14 4/496
2008/0128204 A1 * 6/2008 Engstrom ..... A01M 31/02 182/116
2009/0308003 A1 * 12/2009 Juneau ..... E04H 4/144 52/184
2011/0011674 A1 1/2011 Kim
2012/0073902 A1 * 3/2012 Honeycutt ..... E04F 11/025 182/113
2013/0008743 A1 * 1/2013 Hedley ..... E06C 1/393 182/95
2013/0025042 A1 * 1/2013 Lin ..... E04H 4/144 4/494
2013/0186710 A1 7/2013 Moss et al.
2014/0182340 A1 * 7/2014 Sharland ..... E06C 9/12 65/171
2014/0318892 A1 * 10/2014 Meyen ..... E06C 5/22 182/127

* cited by examiner

CUSTOM MOLD PRESS LADDER

TECHNICAL FIELD

The presently disclosed apparatus is generally directed to ensuring safe operation and maintenance of custom mold process vessels. More particularly, the presently disclosed apparatus is directed to an access and egress means for operation and maintenance personnel to safely work in and around custom mold presses.

BACKGROUND

Several solutions exist for tire retreading processes that employ mold cure retreading. Custom mold retreads may be cured in multi-segment presses (e.g., 10-segment presses) to provide uniformity and allow for complex and deeper tread designs. The tire casing is measured and selected for a precise fit into the mold and is cured to exact times based on the tread design selected. Custom mold retreads may be cured to manufacturer-specified protocols for time, temperature, and pressure.

During mold cure retreading, uncured tread rubber is applied to a buffed tire carcass that is placed into a rigid mold incorporating a tread design. Upon heating the mold (e.g., at temperatures from about 120° C. to about 150° C.), the uncured rubber flows and adheres to the tire, resulting in a tire appearance similar to that of a new tire. Because mold cure retreading processes are amenable to versatile tread patterns and extensive repairs, custom molds are often employed to fulfill customer tread performance requirements. As used herein, "custom mold" and "custom molding" refer, without limitation, to the respective devices and processes that employ mold cure retreading as described herein and also employ additional processes as known in the art.

A separate mold is required for each tread and size, requiring a large investment in the operation and maintenance of a range of molds. Such molds are disposed in a mold press, an example of which is mold press 10 shown in FIG. 1. Mold press 10 may include a frame 10*a* that may have one or more frame supports 10*b* as shown. Press frame 10*a* includes an outer surface 10*a*' and an inner surface with the latter delineating a recess in which at least one mold is disposed during custom mold retread processes. Mold press 10 is an example of a variety of commercially available mold presses that are amenable for use in mold cure retreading systems.

Operators, technicians and maintenance personnel (collectively, "personnel" and "service personnel") must often climb into and out of custom mold presses to insert and remove the molds, clean the molds and/or complete required preventive maintenance on the molds. Such personnel not only come into proximity of the flowing rubber at elevated temperatures. They also approach adjacent machinery that may be subject to operation in concert with the mold presses. Such conditions contribute to potentially unsafe environments for the personnel as well as reduced efficiency of the employed retread process.

Accordingly, improved access to and egress from custom mold presses would not only benefit the overall safety of custom mold personnel but also contribute to more efficient production in custom mold facilities.

SUMMARY

A custom, mold press ladder is provided that employs an existing custom mold press frame to support itself thereon.

The ladder includes a ladder frame having a pair of elongate members depending generally in parallel relative to one another with a predetermined distance defined therebetween. Each elongate member has a predetermined length coextensive with a support extent and an opposed free extent. One or more steps are securely disposed between the elongate members so as to support a person stepping thereon. A platform is provided that includes a predetermined platform length and a predetermined platform width generally corresponding to the predetermined distance between the elongate members. The platform is supported along a length of the elongate members intermediate the support extents and free extents thereof. The platform includes a support surface and an opposed anchoring surface from which an anchor depends downwardly to facilitate initial installation and securement of the ladder relative to the mold press frame. The ladder also includes a pair of scaffold members depending upwardly from the platform support surface in parallel relation to one another. The scaffold members are separated by a distance about equal to the predetermined platform width, with each scaffold member having a predetermined height coextensive with a fixed scaffold extent and an opposed free scaffold extent. The ladder is provided with at least one grab bar having opposed free extents removably secured to corresponding free extents of the elongate members and the scaffold members. A clamping engagement system removably secures the ladder to the mold press frame.

The clamping engagement system may include at least one of an articulating clamp and a safety clamp. The articulating clamp can include a pair of arms in operable communication with one another via a link. Operation of a clamp handle opens and closes the arms relative to one another, with each arm having a free extent that engages at least a portion of the mold press frame. The safety clamp includes a clamp handle for transmitting movement to a stop that frictionally engages the mold press frame. The articulating clamp may be provided proximate the support extent. The safety clamp may be provided along a length of the elongate members intermediate the articulating clamp and the anchor. A notch may be optionally provided in one or both of the free arm extents. Each notch has edges for engagement with at least a portion of the mold press frame.

The scaffold members may depend upwardly from a leading edge of the platform.

A pair of grab bars may be provided in generally parallel relation to one another and separated by a distance about equal to the predetermined platform width. Each grab bar is hingedly maneuverable relative to the elongate members and the scaffold members.

The ladder may also include one or more wheels in operable communication with the support extent of each elongate member for transporting the ladder. The ladder may instead include a fixed leg disposed at the support extent of each elongate member for supporting the ladder in a stationary position. In some embodiments, the ladder may be modular in that the wheels and legs may be selectively substituted for one another to change the ladder between a transport state and a stationary state.

A clamping engagement system is also provided for use with a ladder as presently disclosed herein.

Further provided is a method for installing an access and egress apparatus on a custom mold press. The method includes providing a ladder as presently disclosed and transporting the ladder to a location along a mold press frame. The ladder is lifted on to the mold press frame such that an anchor engages the frame. The clamping engagement system is brought into engagement with the mold press frame to ensure securement.

A kit is also provided for installing a ladder as presently disclosed with a mold press frame.

Other aspects of the presently disclosed apparatus will become readily apparent from the following detailed description.

BRIEF DESCRIPTION OF THE DRAWINGS

The nature and various advantages of the present invention will become more apparent upon consideration of the following detailed description, taken in conjunction with the accompanying drawings, in which like reference characters refer to like parts throughout, and in which.

DETAILED DESCRIPTION

Figure 1:
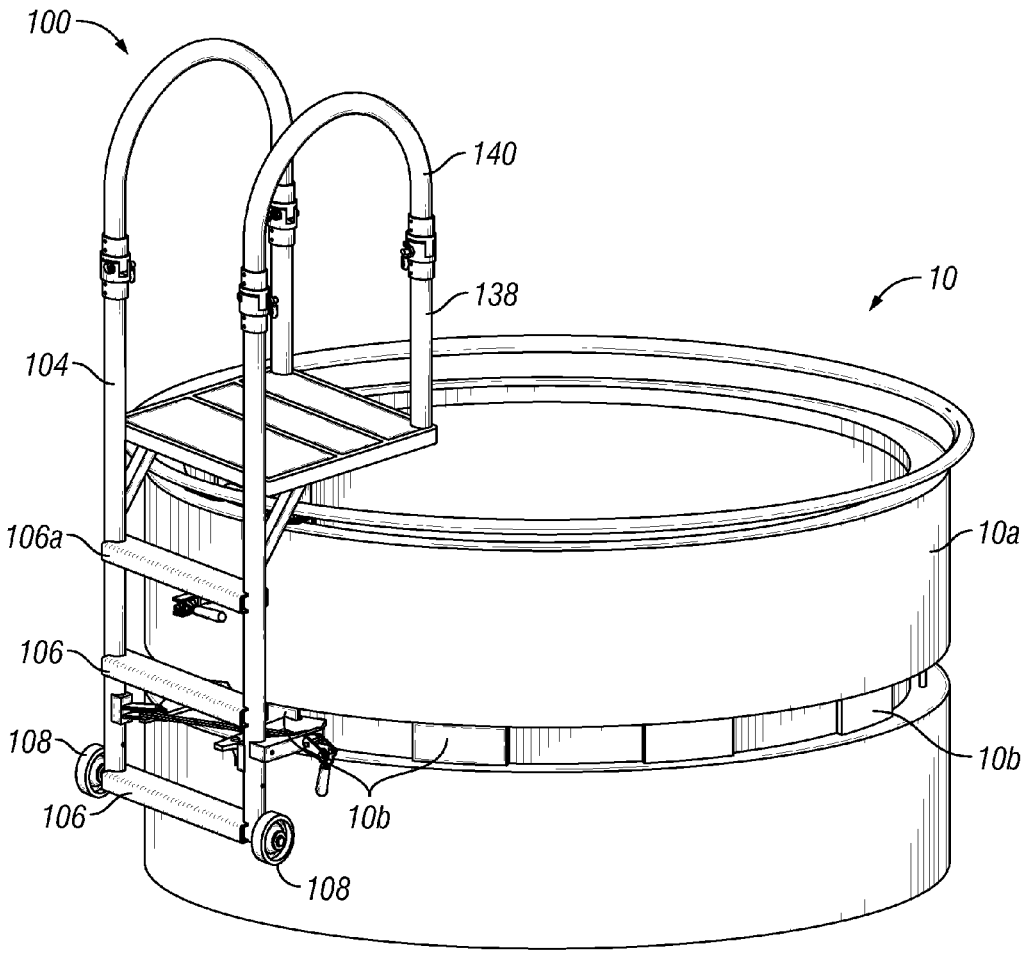
FIG. 1 shows an exemplary environment in which an exemplary custom mold press ladder is installed relative to an existing mold press.

Now referring to the figures, wherein like numbers represent like elements, FIG. 1 shows a custom mold ladder 100 as an access and egress means for mold press 10. Ladder 100 employs an existing custom mold press frame 10*a* to support itself (as further described herein). It is understood that ladder 100 is amenable for use with a variety of mold presses and is not limited to use with mold press 10 as shown.

Figure 2:
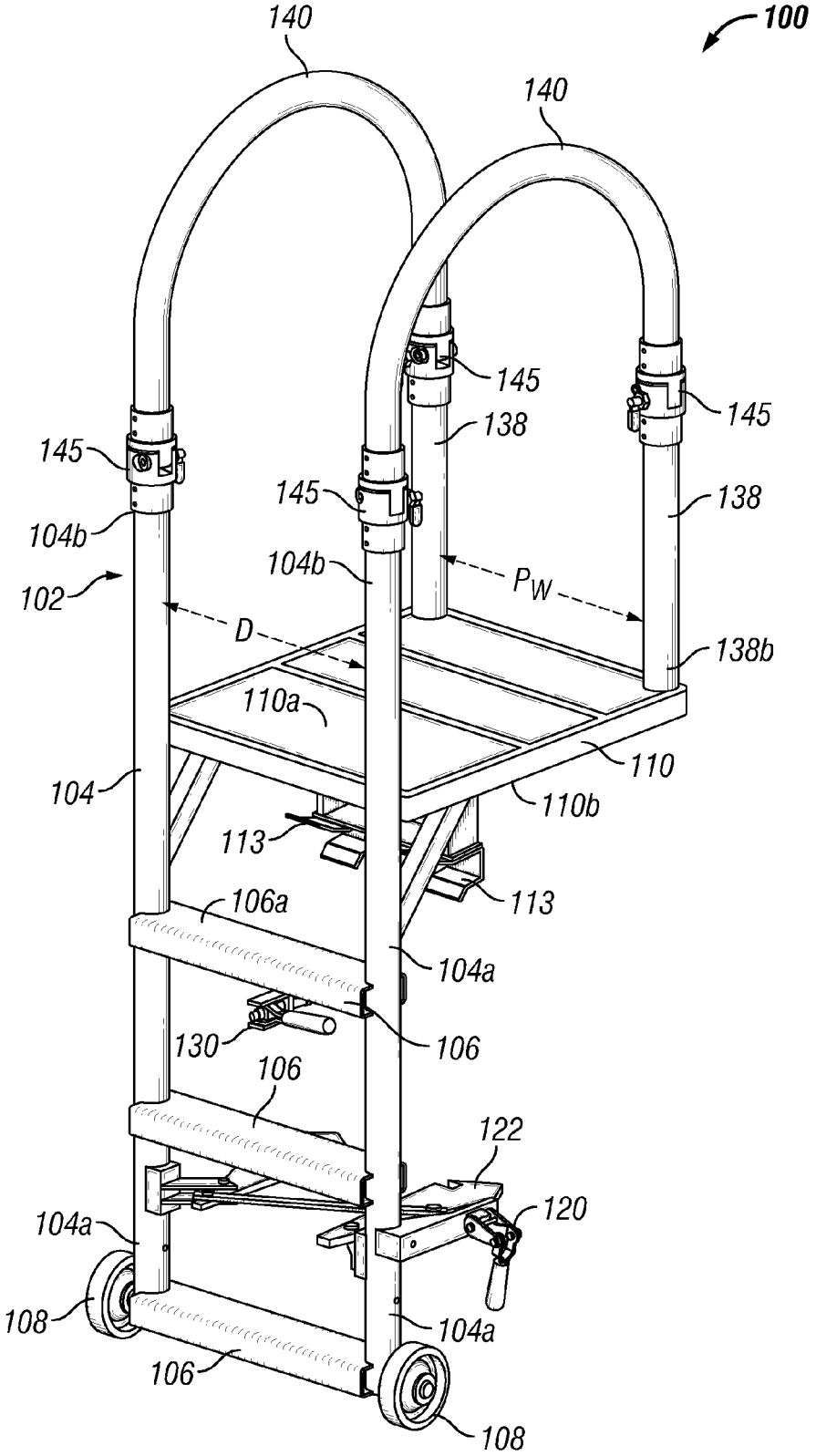
FIGS. 2 and 3 show respective top perspective and bottom perspective views of the custom mold press ladder of FIG. 1.
Figure 3:
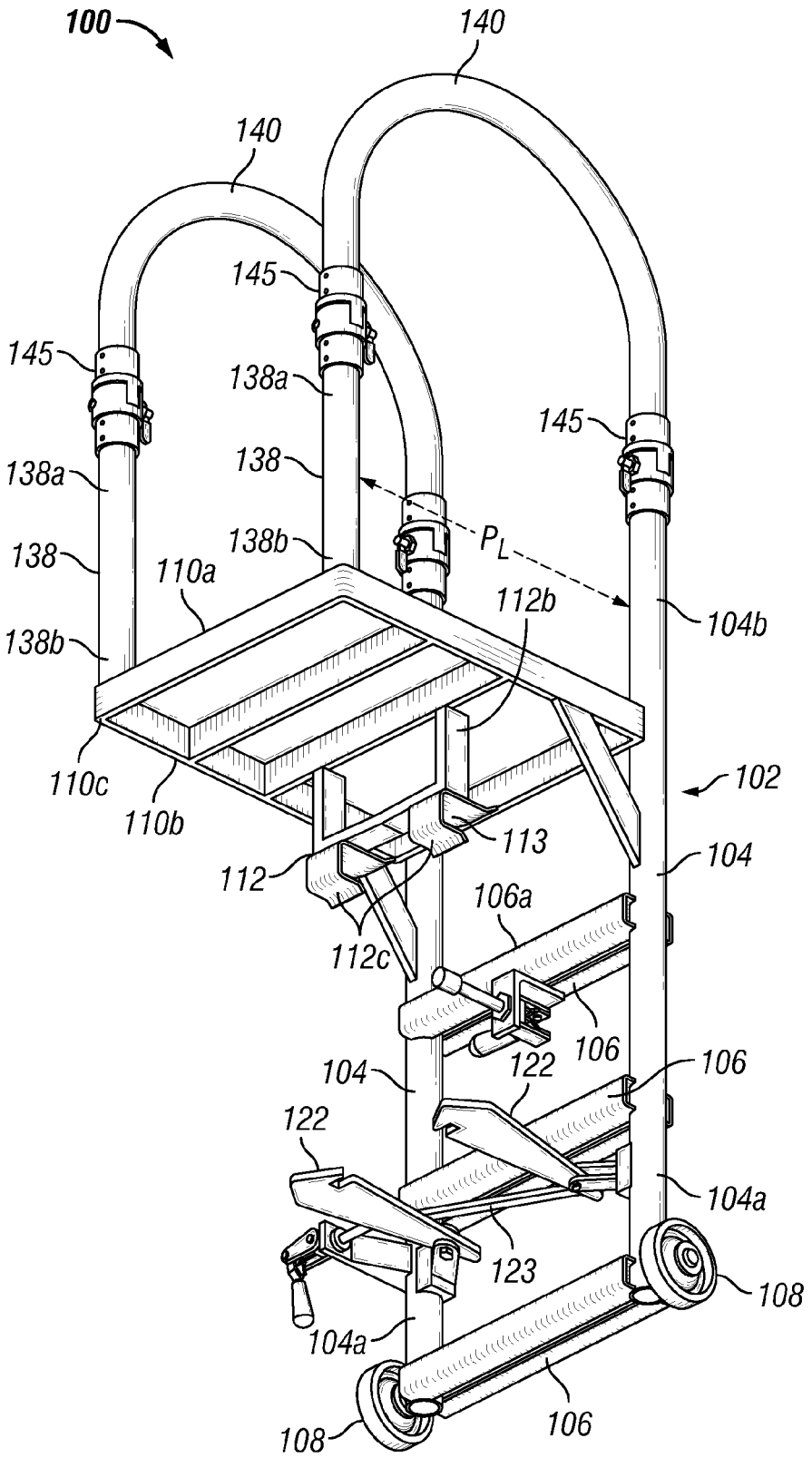

Referring further to FIG. 1 and additionally to FIGS. 2 and 3, ladder 100 includes a ladder frame 102 having a pair of elongate members 104 each having a predetermined length extending between a support extent 104*a* and a free extent 104*b*. Elongate members 104 depend generally in parallel relative to one another with a predetermined distance D defined therebetween. One or more steps 106 may be securely disposed along the elongate members' length so as to traverse distance D and support the weight of a person stepping thereon. Although three steps are shown in the figures, it is understood that fewer or more steps may be employed without departing from the scope of this disclosure. Distance D, while being adjustable to a plurality of personnel and conditions, should be sufficient to permit securement of steps 106 with elongate members 104 and also to facilitate passage of personnel between the elongate members.

Optional means for transporting ladder 100 may be provided (e.g., along a perimeter of a single mold press, between adjacent mold presses, from one location to another in a retreading facility, etc.). As shown herein, such transport means are provided as one or more wheels 108 in operable communication with support extent 104*a* of each elongate member 104. As shown herein, a step 106 is provided directly between wheels 108, although it is understood that the positioning of such a step is variable (e.g., there may be no step located between wheels 108, or the step may be offset from the rotational axes of wheels 108). Although one wheel 108 is shown at each support extent 104*a*, it is understood that more than one wheel may be so positioned. It is also understood that equivalent and/or complementary transport means may be used instead of wheels 108 (e.g., one or more roller bearings, etc.). It is additionally understood that ladder 100 may be provided without any wheels and may instead have fixed legs (not shown) that impede any rolling or sliding movement of the ladder. In some embodiments, there may be a modular option provided at each support extent 104*a* that permits fixed legs and wheels to be substituted for one another, thereby permitting alteration of the ladder between a transport state and a stationary state.

Referring still to FIGS. 2 and 3, elongate members 104 support a platform 110 along the length thereof intermediate a topmost step 106*a* and free member extents 104*b*. Platform 110 includes a support surface 110*a* upon which personnel are supported while servicing the mold press and an anchoring surface 110*b* from which an anchor 112 depends downwardly (as further described herein). Platform 110 has a predetermined width $P_w$ generally corresponding to predetermined distance D so that personnel remain safely supported by ladder 100 when the ladder is installed with the mold press. Platform 110 also has a predetermined length $P_l$ sufficient to safely support personnel thereon and provide reliable access to, and egress from, the mold press during servicing. As used herein, "servicing" includes, but is not limited to, inserting and removing molds into and from the mold press, cleaning the molds, completing required maintenance on the molds and/or the press and any other activities regularly performed by personnel to ensure optimal performance of the molds and mold press.

Figure 8:
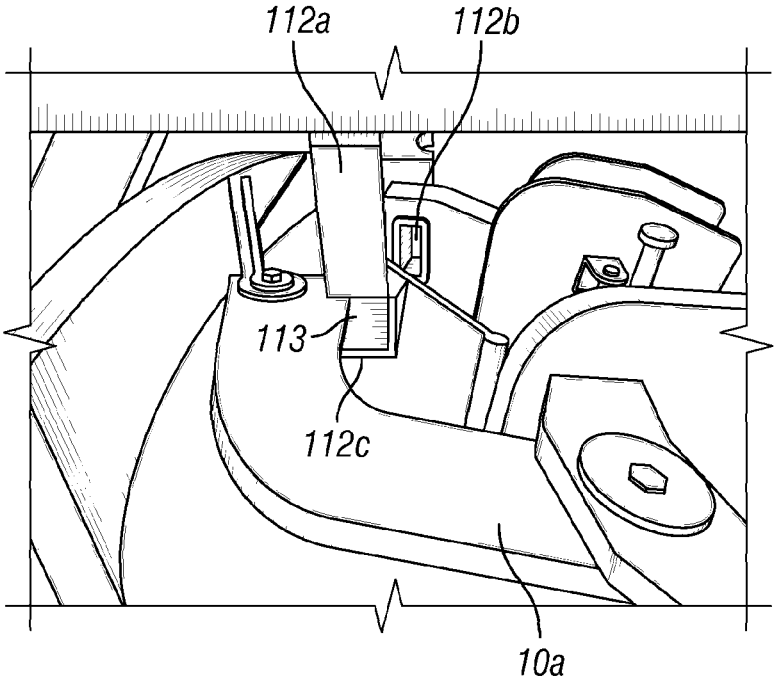
Figure 9:
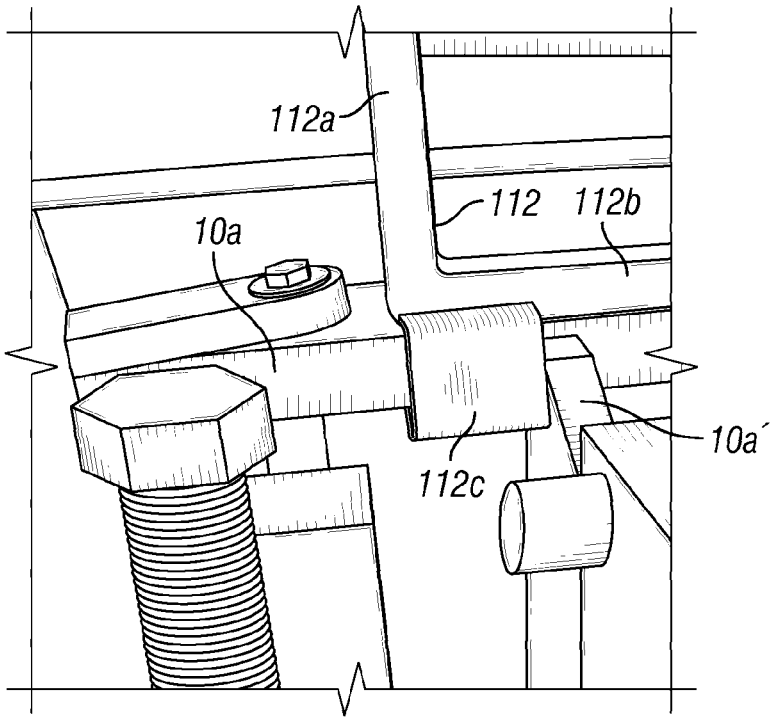

Anchor 112 depends downwardly from platform anchor surface 110*b* to facilitate initial installation and securement of ladder 100 relative to the mold press. Anchor 112 may include at least one generally depending member 112*a* that terminates in a support link 112*b* from which one or more supports 112*c* depend. In some embodiments there may be a single depending member from which supports 112*c* depend. In some embodiments, such as the exemplary embodiment shown in FIGS. 2 and 3 (and further shown in FIGS. 8 and 9), two or more depending members may be provided in parallel alignment and having a predetermined distance therebetween (which distance may be varied in relation to the type of mold press with which ladder 100 is being installed). As shown in the exemplary embodiment, a pair of supports 112*c* is provided in an embodiment in which each support 112*c* includes a profile that delineates a support channel 113 for ladder 100 to engage at least a portion of the mold press frame. Support channel 113 may exhibit a C-shaped or U-shaped profile. In some embodiments, supports 112*c* may have other profiles that are amenable to operation of ladder 100.

Figure 4:
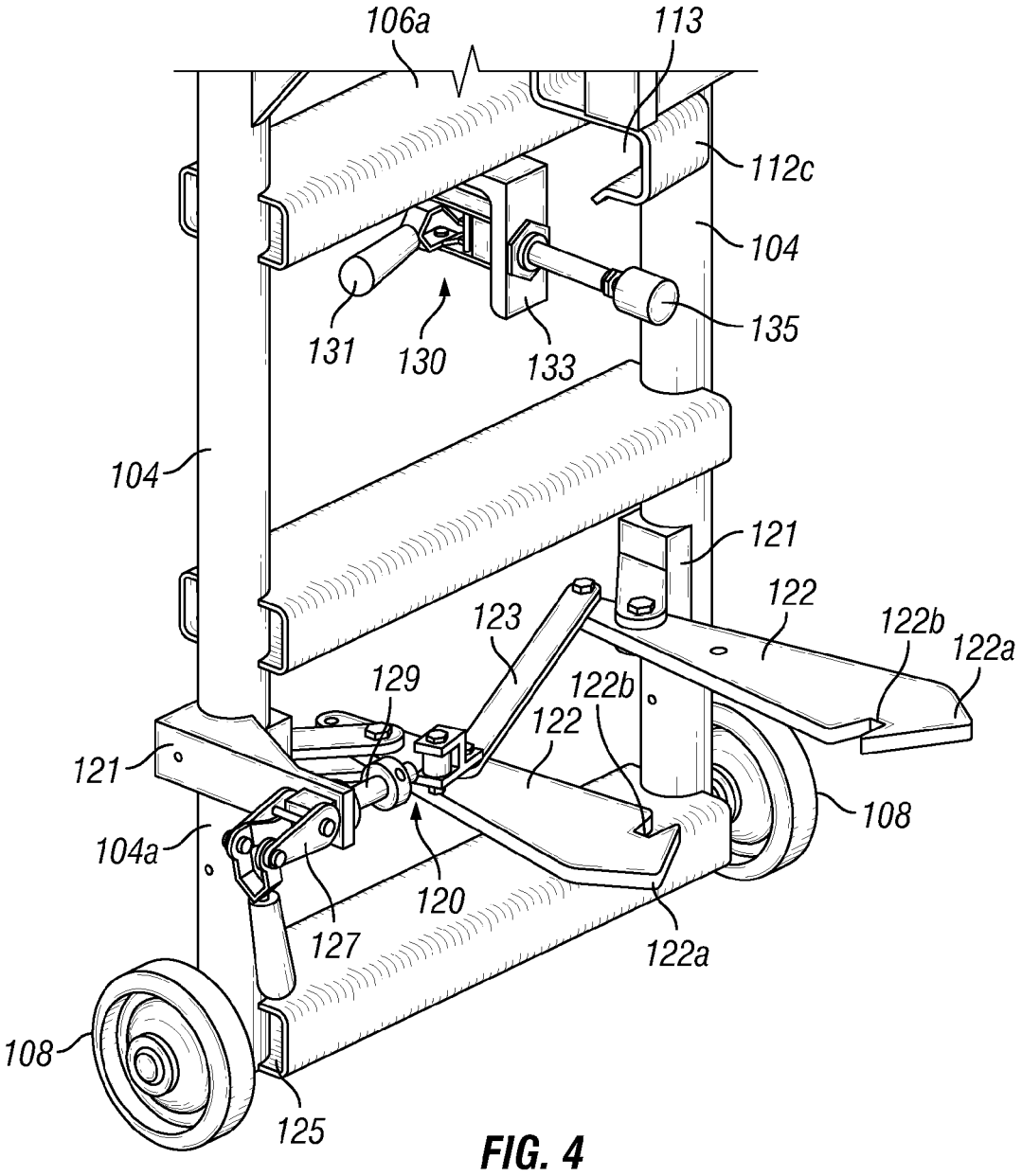
FIG. 4 shows a partial perspective view of the of the custom mold ladder of FIG. 1 and an exemplary clamp engagement system thereof.

Referring further to FIG. 4, a clamping engagement system may be provided with ladder 100 for additional securement to the mold press. The clamping engagement system includes at least one of an articulating clamp 120 and a safety clamp 130. Articulating clamp 120 may be integral with or affixed to ladder frame 102 by one or more ladder brackets 121 or by any other equivalent and/or complementary attachment means. Articulating clamp 120 includes a pair of actuatable arms 122 in operable communication with one another via a link 123. Each arm 122 includes a free extent 122*a* that engages at least a portion of the mold frame (e.g., at frame support 10*b* of mold frame 10*a* as shown in FIG. 1, herein).

Figure 10:
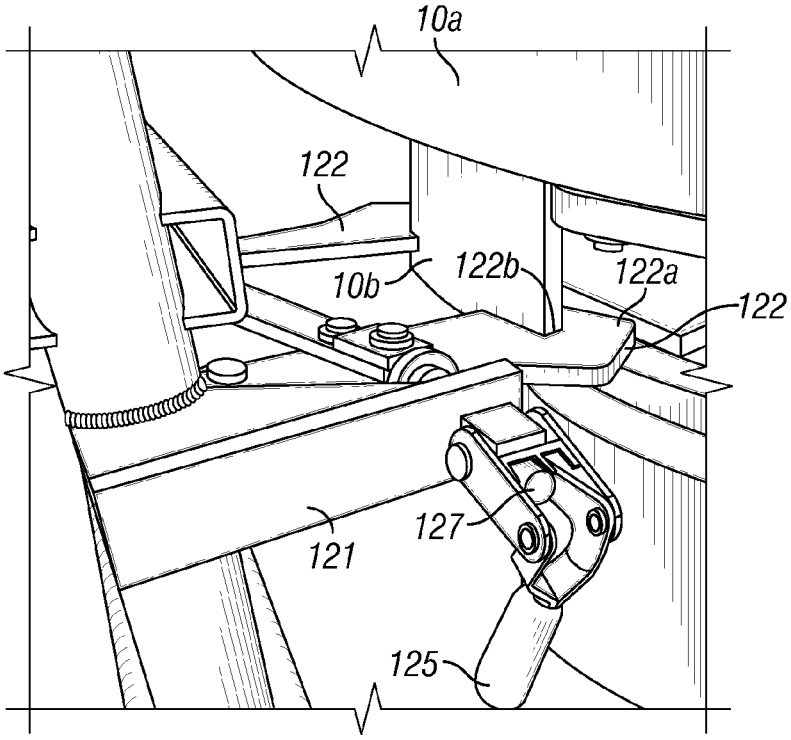

An optional notch 122*b* may be provided in one or both of free arm extents 122*a* to ensure secure engagement of each arm with the frame along the edges of each notch 122*b* (e.g., see an exemplary engagement of notches 122*b* with frame support 10*b* in FIG. 10). A clamp handle 125 is rotatably supported by a handle bracket 127 such that rotation of clamp handle 125 transmits motion through an auxiliary arm 129 to link 123. Selective operation of clamp handle 125 translates into opening and closing of arms 122 relative to one another.

Figure 11:
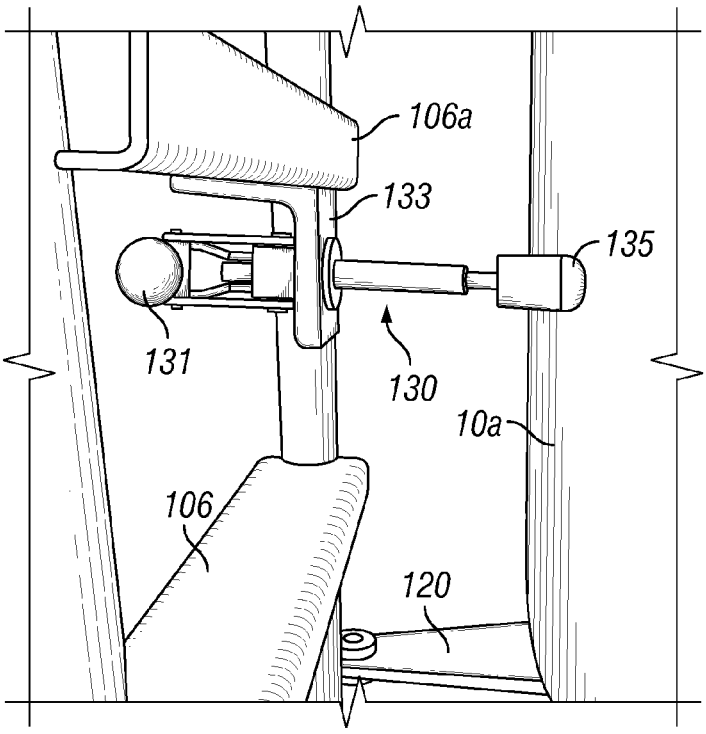

In some embodiments, as further shown in FIG. 4, a safety clamp 130 is provided that includes a clamp handle 131. Safety clamp may be integral with or affixed to ladder frame 102 by one or more safety clamp brackets 133 or by any other equivalent and/or complementary attachment means. Safety clamp 130 includes an actuatable stop 135 that engages at least a portion of a mold frame (e.g., stop 135 may engage mold frame 10*a* as shown in FIG. 11). Clamp handle 131 may be hingedly connected with bracket 133 and stop 135 such that articulation of clamp handle 131 positions stop 135 to frictionally engages the mold press.

In the embodiments shown, articulating clamp 120 and safety clamp 130 are depicted at relative distances to the elongate members and to one another. In an embodiment as shown in FIGS. 2 to 4, an articulating clamp 120 is provided proximate support extents 104*a*. In an embodiment as shown in the same figures, safety clamp 130 is provided along a length of elongate members 104 intermediate articulating clamp 120 and anchor 112. It is understood that the location of at least one of articulating clamp 120 and safety clamp 130 may be adjusted in accordance with the parameters of the mold press and the physical attributes of the person performing service.

One or more scaffold members 138 are provided that depend upwardly from platform support surface 110*a*. In some embodiments, such as the exemplary embodiment shown in FIGS. 2 and 3, scaffold members are provided in parallel relation to one another and separated by a distance about equal to the predetermined platform width $P_w$. Each scaffold member 138 has a predetermined height coextensive with a free scaffold extent 138*a* and an opposed fixed scaffold extent 138*b* secured on platform support surface 110*a*. In some embodiments, scaffold members 138 depend upwardly from a leading edge 110*c* of platform 110, thereby providing service personnel with a visual indication of the platform edge.

As an additional safety feature, some embodiments of ladder 100 include at least one grab bar 140 having opposed free extents 140*a* removably secured to corresponding free extents 104*a* and 138*a* of elongate members 104 and scaffold members 138, respectively. Each grab bar 140 may be hingedly maneuverable relative to a free extent 104*a* of corresponding elongate member 104. As shown in FIG. 1 and further illustrated in FIGS. 5 and 6, a pair of grab bars 140 may be provided in generally parallel relation to one another and separated by a distance about equal to the predetermined platform width $P_w$. As shown herein, each grab bar exhibits a generally C-shaped or U-shaped geometry for ready grasping by service personnel, although other geometries are contemplated that are amenable to practice of the presently disclosed invention. At least a portion of one or more grab bars 140 may have a gripping surface integral therewith or placed thereon to provide personnel with additional securement while grasping grab bars 140. In embodiments that include grab bars 140, the placement of scaffold members 138 at or near platform leading edge 110*c* facilitates proper installation of the grab bars for intuitive use by service personnel.

Figure 5:
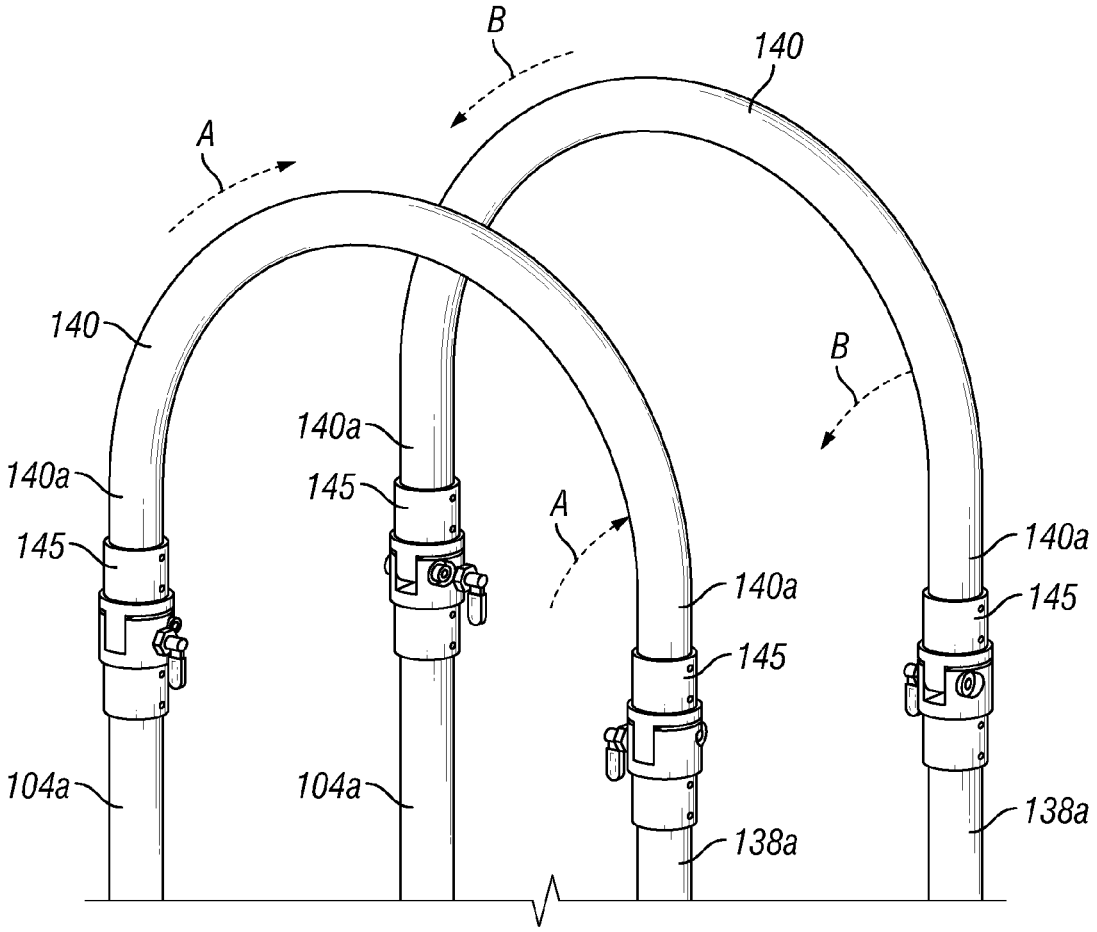
FIG. 5 shows a partial perspective view of the custom mold ladder of FIG. 1 and exemplary grab bars thereof in an upright position.
Figure 7:
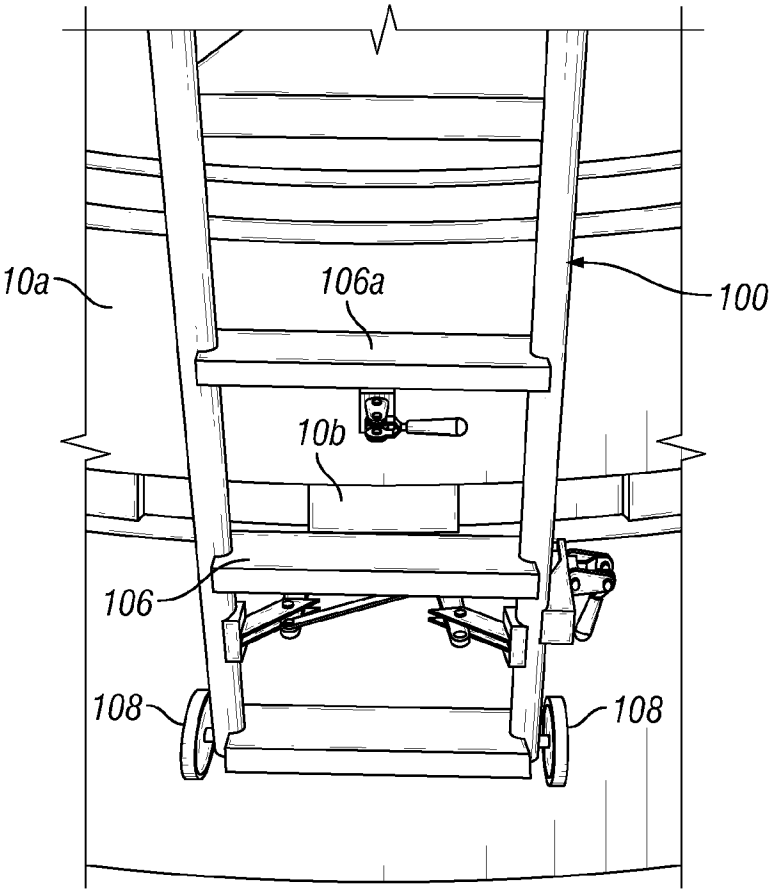
FIGS. 7 to 11 show exemplary installation of a custom mold ladder as presently disclosed.
Figure 6:
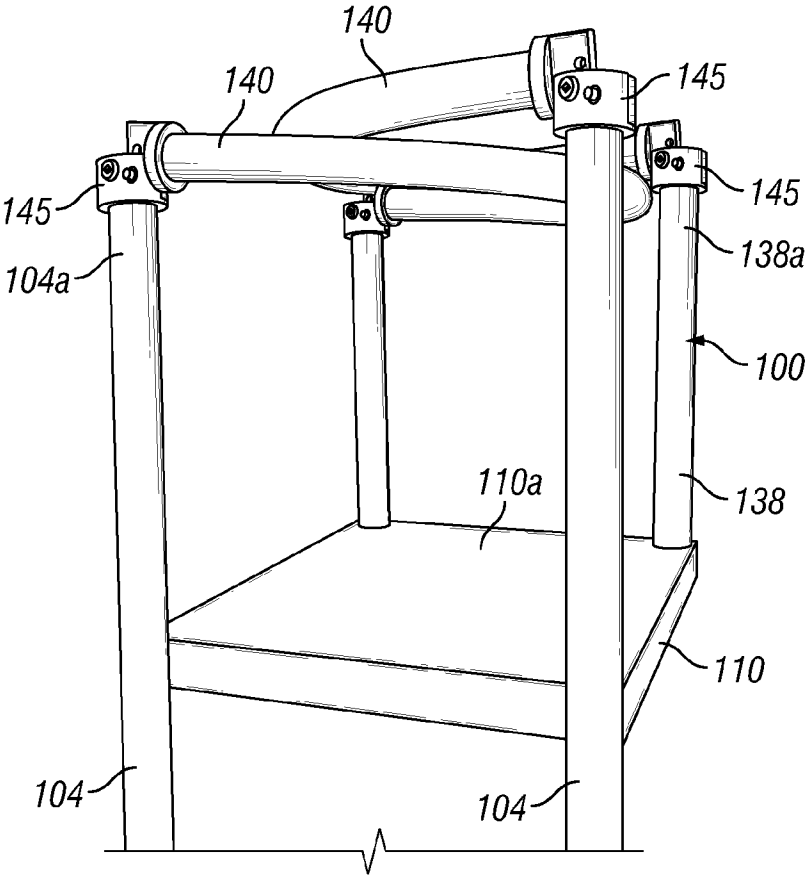
FIG. 6 shows the exemplary grab bars of FIG. 5 in a collapsed position.

In the embodiments shown, free extents 140*a* of grab bars 140 are removably secured to respective free extents 104*a* of elongate members 104 and free extents 138*a* of scaffold members 138. As shown in FIG. 5, securement is established by hinge couplings 145, although any equivalent and complementary securement means may be employed. Hinge couplings 145 enable rotation of grab bars 140 in the direction of arrows A and B (see FIG. 5) relative to elongate members 104 and scaffold members 138. As shown in FIG. 6, the rotation of grab bars 140 allows the grab bars to collapse over platform support surface 110*a*, thereby impeding inadvertent access to platform 110 by service personnel. The selective folding of grab bars 140 promotes additional safety protocols by providing clearance for additional machinery or parts that may pass over ladder 100 (e.g., the grab bars are folded to allow for a tire lifting arm on the press to maneuver above the ladder while the ladder is mounted on the press). The collapsed grab bars serve as both visual and tactile indicia to service personnel that not only alert the personnel to potential safety conditions but also impede access to the ladder while a potentially unsafe condition exists. When the condition subsides and servicing in considered safe, the personnel can easily elevate grab bars 140 to the upright position (e.g., as shown in FIG. 5) and thereby indicate to other personnel that access to the mold press is now permitted.

In some embodiments, an additional structural piece (not shown) may be mounted to the mold press that may then be used to lock ladder 100 to the press. Such embodiments are within the scope of the present disclosure.

An exemplary installation of ladder 100 with a mold press is now described with reference to mold press 10 of FIG. 1. It is understood, however, that similar installation processes may be exercised for the installation of ladder 100 with other mold press configurations as would be readily understood by a skilled person.

Referring to FIGS. 7 to 11, ladder 100 is transported (e.g., by wheels 108) to a location along the press (e.g., along a periphery of press frame 10*a* as shown in FIG. 1). In preferred embodiments, the centerline $L_c$ of ladder 100 is centered with frame support 10*b* with articulating clamp 120 and safety clamp 130 in retracted positions (see FIG. 7). Ladder 100 is lifted on to press frame 10*a* such that anchor 112, and namely support channel 113 thereof, engages frame 10*a* (see FIG. 8). A gusset 10*a*' of frame 10*a* may be employed as a stop for anchor 112 as ladder 100 is installed (see FIG. 9).

Articulating clamp 120 is aligned with frame support 10*b* such that arms 122 (and particularly notches 122*a* of those embodiments incorporating such notches) are ready to engage opposing sides of the frame support (see FIG. 10). Actuation of clamp handle 125 causes link 123 to articulate arms 122 toward one another such that they securely grasp frame support 10*b* thereby. Upon full engagement of articulating clamp 120, clamp handle 131 of safety clamp 130 is actuated until the safety clamp fully engages mold press frame 10*a* (see FIG. 11). Installation of ladder 100 may be performed with grab bars 140 in an upright position (as shown in FIG. 5) or in a collapsed position (as shown in FIG. 6). To remove or reposition ladder 100, the disclosed actions are conducted in reverse order to ensure safe removal of the ladder.

Ladder 100 may be fabricated from a variety of materials. Ladder frame 102 (including one or more of elongate members 104), scaffold members 138 and grab bars 140 may be selected from generally tubular elements that are fabricated from 6061-T6 aluminum or equivalent material. Hinge couplings 145 may be fabricated from 1020 cold rolled steel or any equivalent material that promotes extended life and increases the strength of the ladder. Articulating clamp 120 and/or arms 122 thereof may be constructed from 7075 aluminum or any equivalent material that facilitates weight reduction without compromising strength and wear resistance as necessary for operation of the ladder as disclosed.

The presently disclosed mold ladder enables the safe ingress and egress of service personnel relative to custom mold presses with minimal temporal and fiscal expenditures. The presently disclosed ladder utilizes the existing custom mold press frame to support itself. The ladder is therefore adaptable to a variety of mold press configurations while exhibiting a number of safety features. The presently disclosed custom mold ladder further preserves the efficiency and reliability of the cure mold retread processes being executed by the press while promoting the safety of all associated personnel.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross-referenced or related patent or application is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the disclosed apparatus have been illustrated and described, it will be understood that various changes, additions and modifications can be made without departing from the spirit and scope of the present disclosure. Accordingly, no limitation should be imposed on the scope of the presently disclosed invention, except as set forth in the accompanying claims.

What is claimed is:

1. A ladder for use with an existing custom mold press frame to support itself thereon, the ladder comprising:

a ladder frame having a pair of elongate members depending generally in parallel relative to one another with a predetermined distance defined therebetween, with each elongate member having a predetermined length coextensive with a support extent and an opposed free extent;

one or more steps securely disposed between the elongate members so as to support a person stepping thereon;

a platform having a predetermined platform length and a predetermined platform width generally corresponding to the predetermined distance between the elongate members, the platform being supported along a length of the elongate members intermediate the support extents and the free extents thereof and including a support surface and an opposed anchoring surface from which an anchor depends downwardly to facilitate initial installation and securement of the ladder relative to the mold press frame, wherein the anchor has a support that defines a support channel, wherein the support and the support channel are both spaced from and free from engagement with the steps and the elongate members, wherein the support channel is spaced from and free from engagement with the anchoring surface, and wherein the support channel is located under the platform such that the support channel is under a footprint of the platform in that the predetermined platform length of the platform is located both forward and rearward of the support channel, and such that the predetermined platform width is located both leftward and rightward of the support channel;

a pair of scaffold members depending upwardly from the platform support surface in parallel relation to one another and separated by a distance about equal to the predetermined platform width, with each scaffold member having a predetermined height coextensive with a fixed scaffold extent and an opposed free scaffold extent;

at least one grab bar having opposed free extents removably secured to corresponding free extents of the elongate members and the scaffold members; and a clamping engagement system on the elongate members, the clamping engagement system configured to removably secure the ladder.

2. The ladder of claim 1, wherein a plurality of the supports are present, wherein the anchor includes a support link from which the supports depend.

3. The ladder of claim 2, wherein two of the supports are present and the support channels of the two supports are in parallel alignment.

4. The ladder of claim 3, wherein the support channels are C-shaped.

5. The ladder of claim 2, wherein the clamping engagement system comprises:

an articulating clamp including a pair of arms in operable communication with one another via a link, wherein the articulating clamp has a clamp handle that is configured to be actuated to open and close the arms relative to one another, with each arm having a free arm extent that is configured to engage at least a portion of the mold press frame; and a safety clamp that includes a clamp handle for transmitting movement to a stop that frictionally engages the mold press frame.

6. The ladder of claim 5, wherein the articulating clamp is provided proximate the support extent and the safety clamp is provided along a length of the elongate members intermediate the articulating clamp and the anchor.

7. The ladder of claim 5, wherein a notch is provided in one or both of the free arm extents and each notch having edges for engagement with at least a portion of the mold press frame.

8. The ladder of claim 2, wherein the scaffold members depend upwardly from a leading edge of the platform.

9. The ladder of claim 8, wherein the at least one grab bar is a pair of grab bars provided in generally parallel relation to one another and separated by a distance about equal to the predetermined platform width with each grab bar being hingedly maneuverable relative to the elongate members and the scaffold members.

10. The ladder of claim 1, further comprising one or more wheels for transporting the ladder, wherein the one or more wheels are in operable communication with the support extent of each elongate member.

11. The ladder of claim 1, wherein the clamping engagement system further comprises at least one of:

an articulating clamp including a pair of arms in operable communication with one another via a link such that operation of a clamp handle opens and closes the arms relative to one another, with each arm having a free extent that engages the mold frame; and a safety clamp that includes a clamp handle for transmitting movement to a stop that frictionally engages the mold press frame.

12. A kit comprising:

the ladder according to claim 1; and instructions for installing the ladder on the mold press frame.

* * * * *